US005826276A

United States Patent [19]

Garceau-Verbeck

[11] Patent Number: 5,826,276

[45] Date of Patent: Oct. 27, 1998

[54] ERGONOMIC HAND COVERING AND GRIP ENHANCER

[76] Inventor: Dorothy S. Garceau-Verbeck, 7445 E. Cole Rd., Durand, Mich. 48429

[21] Appl. No.: 709,028

[22] Filed: Sep. 6, 1996

Related U.S. Application Data

[63] Continuation-in-part of Ser. No. 209,112, filed as PCT/US95/01399, Feb. 1, 1995, Pat. No. 5,459,883.

[51] Int. Cl.[6] ..... A41D 19/00

[52] U.S. Cl. ..... 2/161.1; 2/16

[58] Field of Search ..... 2/16, 20, 159, 2/161.1, 161.2, 161.4, 161.6, 162, 170; 482/44, 49; 473/59, 62

[56] References Cited

U.S. PATENT DOCUMENTS

| | | | |
|---|---|---|---|
| 325,968 | 9/1885 | Rawlings | 2/19 |
| 368,724 | 8/1887 | Loucks | 2/20 |
| 482,647 | 9/1892 | Obear | 2/20 |
| 975,734 | 11/1910 | Tebeau | 2/20 |
| 1,351,311 | 8/1920 | Virneburg | 2/20 |
| 1,716,221 | 6/1929 | Fernie | 2/161.1 |
| 2,154,197 | 4/1939 | Callaway | 2/159 |
| 2,270,363 | 1/1942 | Weeber . | |
| 2,547,388 | 4/1951 | Griffin | 2/20 |
| 3,269,728 | 8/1966 | Blough | 473/62 |
| 3,344,436 | 10/1967 | Stubbs | 473/59 |
| 3,369,258 | 2/1968 | Smith | 2/159 |
| 3,421,160 | 1/1969 | Domenico | 473/59 |
| 4,042,977 | 8/1977 | Antonious . | |
| 5,081,715 | 1/1992 | Mascia | 2/20 |

*Primary Examiner*—Michael A. Neas
*Attorney, Agent, or Firm*—Harness, Dickey & Pierce, P.L.C.

[57] ABSTRACT

An ergonomic hand covering and grip enhancer (1) adapted to be worn by a person to provide protection, support and enhanced gripping capabilities is described herein. In an alternative embodiment (100), the construction is formed to fit the wearer in a continuum with the contour of the palm wherein the fit is sustained throughout expansion and contraction of the hand without bunching or interfering with the hand's movement or sensitivity.

24 Claims, 2 Drawing Sheets

9a
11
12
9
9a
10
13
2
1
3
7
8
14
15
6
5
7

9
9a
15
17
1
5
3
2
16
6
8
7

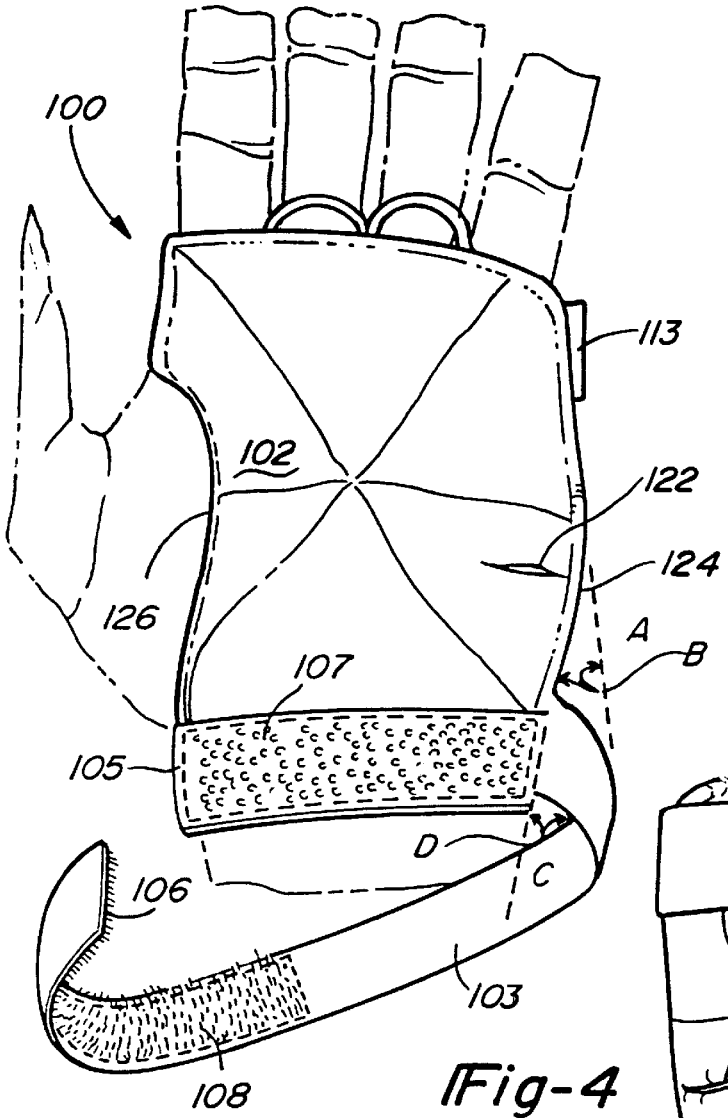
Fig-3
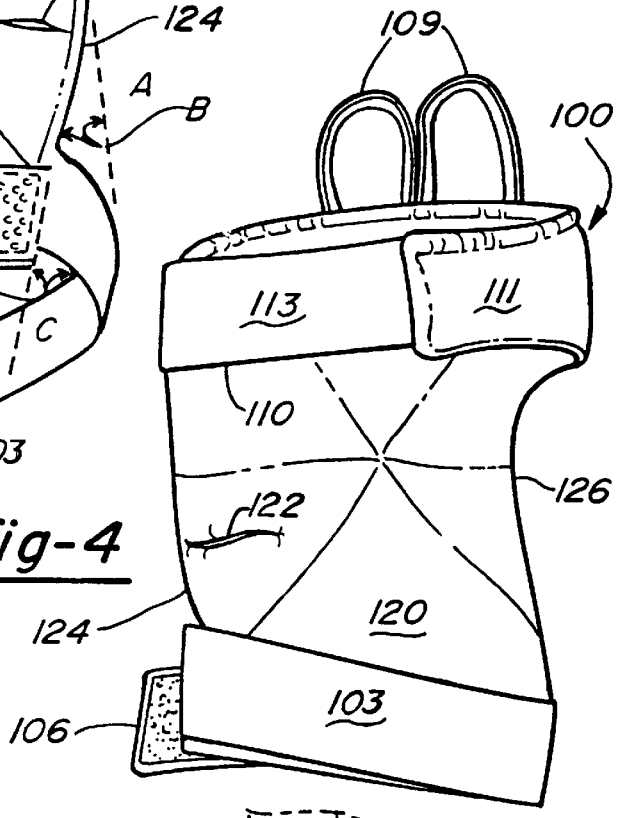
Fig-4
Fig-5
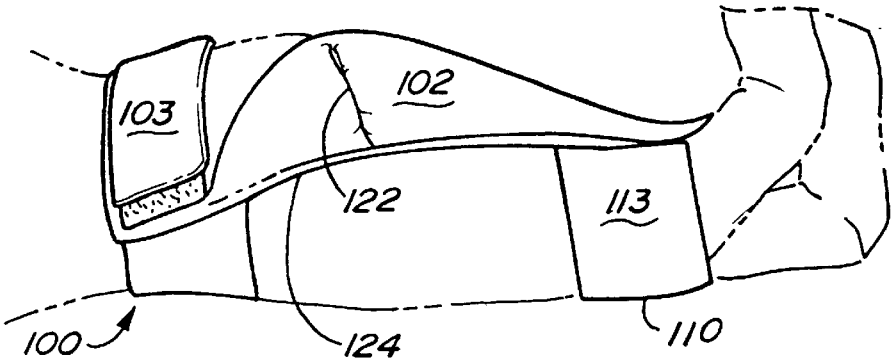

ERGONOMIC HAND COVERING AND GRIP ENHANCER

RELATED APPLICATIONS

This is a continuation of PCT Application Number PCT/US95/01399, filed on Feb. 1, 1995, which in turn is a continuation-in-part of U.S. application Ser. No. 08/209,112 filed Mar. 9, 1994, now U.S. Pat. No. 5,459,883.

FIELD OF THE INVENTION

This invention relates to a hand covering and grip enhancer for protection, support and an enhanced grip when gripping an article such as a golf club, tennis racket, or other article.

BACKGROUND OF THE INVENTION

It is common practice for a worker or an athlete to wear a glove on one or both hands to provide support for the hands and wrists and to enhance the grip that may be applied to an article such as a golf club, tennis racket, or other equipment. It is not uncommon for typists, food servers, and others engaged in occupations that stress the hand and wrist to make use of a glove-like support or hand covering. One currently available form of glove completely encloses the hand, including the thumb and four fingers, whereas another form of glove accommodates the palm and back of the hand and the first joint of the thumb and four fingers. In either case, the palm and back of the hand are poorly ventilated, if at all, with the result that the material from which the glove is made becomes saturated with perspiration, especially on hot, humid days.

There are other devices, not properly called gloves, which are used by persons to apply compressive force on arms or wrists, but these devices do not enhance the person's grip on an article.

Although some presently available gloves do enhance the grip with which a person may hold an article, such gloves provide little, if any, support for the person's hand or wrist. Neither do they provide much, if any, cushioning of the palm of the hand.

A grip enhancer and hand covering constructed according to the present invention provides adequate coverage of the palm of a person's hand to ensure protection for the palm and enhancement of the grip; provides adequate ventilation for a person's hand, thereby minimizing the positioning changes and consequent loss of gripping security to which the device is subjected; and, provides continuous, yieldable support for the person's hand and wrist.

It is also known in the art that certain sports or activities, such as golf, require unique characteristics in a hand grip article wherein it may not be necessary to provide the degree of support discussed above. However, while flexibility for free movement of the hand may be desirable, it is also known that a yieldable material of adequate size to cover the palm in an outstretched position bunches or gathers on the hand as the hand contracts to a grip position. This bunching of material on the palm of the hand is known to cause blisters to form on the wearer. It is also known that activities such as golf require tremendous precision and sensitivity, and thus, improperly fitting or cumbersome hand grip article could effect the skill of the wearer. Similarly, a hand grip article which causes the hand to perspire could adversely affect the skill of the wearer by causing slippage. Therefore, it is desirable to provide a hand grip article which yieldably covers the palm portion of the hand and prevents bunching of material as the hand contracts to a grip position. It is further desirable to provide such a hand grip article which provides enough ventilation so as not to contribute to the build up of perspiration.

SUMMARY OF THE INVENTION

A grip enhancer and hand covering constructed according to the preferred embodiment of the invention has a panel formed of suitable pliable, relatively inelastic material and of such size as to overlie the palm and wrist of a person's hand. That end of the panel adjacent the wrist has secured thereto an elastic anchor strap which may encircle the user's wrist and the adjacent portion of the forearm. The opposite end of the panel has one or more elastic restraining loops adapted to accommodate one or more fingers of the person's hand and thereby restrain bunching of the panel in the wearer's palm.

A retaining band extends from one edge of the panel to its opposite edge and is secured to the opposite edges of the panel in a position to overlie the back of the person's hand at the zone of the knuckles, thereby securely, but yieldably, maintaining the panel in overlying relation with the palm of the hand and enhancing the grip with which the person may hold an article.

An elastic tensioning band is secured at one of its ends to one edge of the panel in a position between the retaining band and the anchor strap and adjacent the little finger (pinky) of the person's hand on which the enhancer is applied. The tensioning band extends diagonally across the panel toward the opposite edge thereof and is secured thereto at a zone within the confines of the anchor strap.

That portion of the panel which overlies the palm of a person's hand may be of multiple thicknesses of material and, if desired, a cushioning pad may be adhered to the panel.

To assist in restraining lateral movement of the wrist of a person, the panel may include a sleeve extending along the length of the panel for the accommodation of a stiff splint.

In accordance with an alternate embodiment of the present invention, the above structure is formed without the diagonal tension band, and the elastic anchor strap is wide enough to encircle the wrist but not the forearm. This construction provides maximum free movement of the hand as required in games such as golf. However, the construction can be formed to provide support to the wrist by enlarging or strengthening the anchor strap. Additionally, the panel portion of this embodiment comprises a dart so as to form an integral hump portion such that it forms a natural continuum with the contour of the palm. The panel portion is further constructed to include an incline at the inner periphery of the panel, the inner periphery being the side which extends from the pinky finger to the wrist. The outer periphery of the panel, the side adjacent the thumb of a wearer, is curved so as not to interfere with movement of the thumb. Thus, this particular embodiment is formed to fit the wearer in a continuum with the contour of the palm wherein the fit is sustained throughout expansion and contraction of the hand without bunching or interfering with the hand's movement or sensitivity.

DESCRIPTION OF THE DRAWINGS

FIG. 3 shows an alternate embodiment of the present invention for purposes of golfing or the like;

FIG. 4 is a perspective view of the rear portion of the gripping article of FIG. 3; and FIG. 5 is a perspective view of the gripping article of FIGS. 3 and 4, shown from the inner periphery or pinky finger side of a wearer's hand.

DETAILED DESCRIPTION

Figure 1:
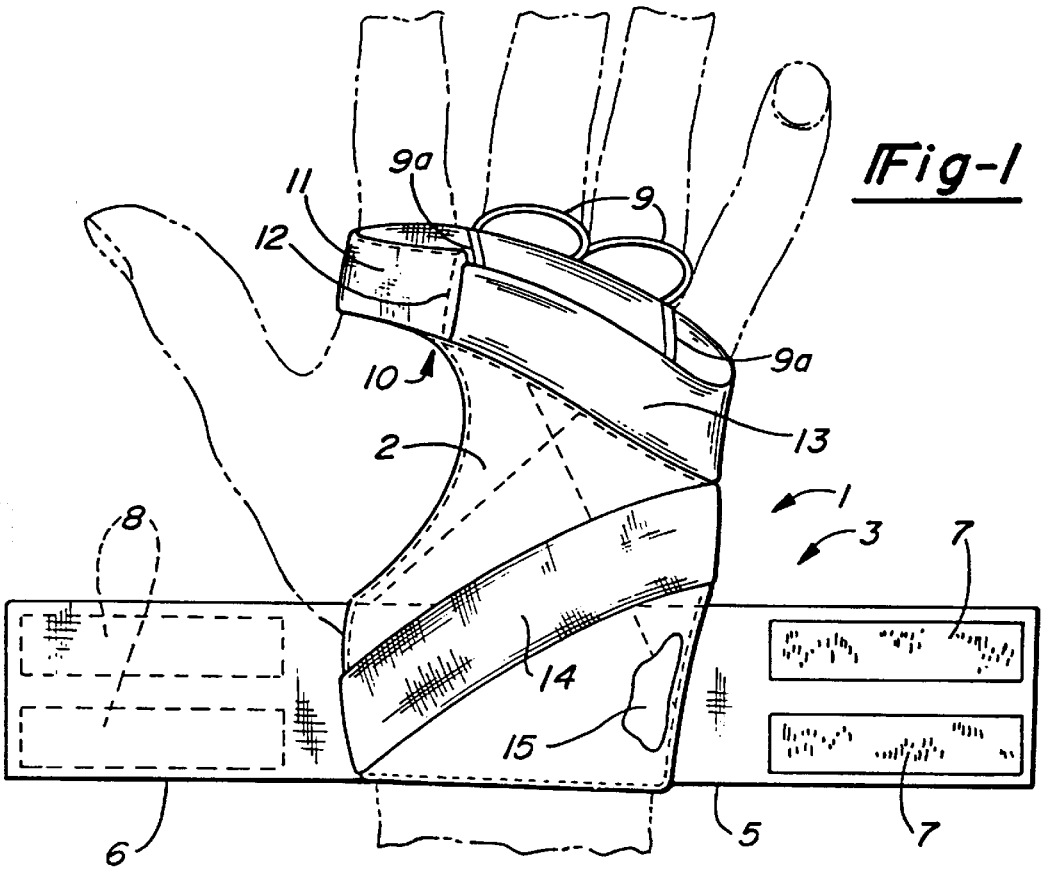
FIG. 1 is a plan view of the back of a person's hand to which the grip enhancer is applied, the hand being shown in phantom.

A grip enhancer and hand covering constructed in a accordance with the disclosed embodiment is designated generally by the reference character 1 and comprises a panel 2 formed of suitable material such as fabric, leather, or a combination of fabric and leather-like or rubbery material. The material from which the panel is formed also may be oil and acid resistant. The panel is of such width as to span the width of a person's hand, preferably an adult, and cover the outside edge of the hand. The panel also is of such length as to extend from the juncture of the person's palm and fingers in a direction toward the wrist and beyond the heel of the hand. The panel, therefore, substantially covers the palm and inside surface of a person's hand and wrist.

To that end of the panel adapted to overlie the wrist is stitched or otherwise suitably secured an elastic anchor strap 3 of such length as to encircle the user's wrist. The strap may be formed as a closed loop of material, but it preferably comprises an elongate strap 3 having a central section 4 that is stitched or otherwise secured to the panel 2. Its opposite end sections 5 and 6 are separable and provided with cooperable fastening means 7 and 8 so as to releasably secure the strap to wrist in encircling relation therewith. Preferably, the fastening means 7 and 8 are adjustable relative to one another to enable the strap to accommodate wrists of different size or apply varying degrees of force on the wrist. The strap preferably is one to four inches in width and a suitable form of fastener comprises the cooperating hooks and loops of a Velcro™ fastener.

Stitched or otherwise suitably secured to the opposite end of the panel 2 is at least one restraining loop 9. In the disclosed embodiment there are two loops 9 each of which is of such size as to accommodate one finger. Each loop preferably is formed of elastic material to facilitate the application and removal of the grip enhancer to the person's hand.

At one edge of the panel 2 and adjacent the finger end thereof is a retaining band 10 comprising an extension 11 of the panel 2 which is adapted to wrap partially around the person's index finger. The extension has a free end 12 which is stitched or otherwise suitably secured to one end of an elastic strip 13 that is adapted to overlie the back of a person's hand. The strip extends toward and is stitched or otherwise suitably secured at its opposite end to the panel 2. The extension 11 and the strip 13 together form the elastic retaining band 10 and span the distance from one side of the panel to the other in a position to overlie the back of a person's hand adjacent the knuckles. The retaining band is of such length that it is elastically stretched when the grip enhancer is applied to a person's hand, thereby securely retaining the finger end of the panel 2 in place.

Two additional restraining bands 9A are stitched or otherwise suitably secured at their opposite ends to the panel 2 and the strap 13, respectively, in a position to lie between two adjacent fingers of a person's hand. These bands perform the same function as the bands 9. In those instances in which the device 1 is worn by a machine operator, the bands 9 may be removed so as to avoid any likelihood that they may catch on some part of the machine. Thus, typically the device is used with only the finger loops 9 or the bands 9A and not both.

An elastic tensioning band 14 is secured at one of its ends to one side of the panel 2 between the retaining band 10 and the strap 3 and at a zone adjacent the retaining band. The tensioning band 14 extends diagonally across the panel and has its opposite end secured to the opposite side of the panel at a zone within the confines of the anchor strap 3. The band 14 is taut so as to lie flat against the panel 2 even when the grip enhancer is not applied to a person's hand.

To apply the grip enhancer to the hand of a person the end portions 5 and 6 of the anchor strap are separated from one another, the hand is inserted between the panel 2, the retaining band 10, and the tensioning band 14. The ring and middle fingers are thrust through the loops 9, with the bands 9*a* between adjacent fingers, and the anchor strap secured in snugly encircling relation about the wrist. In this position the panel 2 confronts the person's palm and the bands 10 and 14 overlie the back of the hand.

In the disclosed embodiment the palm, the heel, and the inside edge or pinky side of the person's hand are covered. The material from which the grip enhancer is made thus makes it possible for the person to grip a golf club, a racket, a bat, or other article without the application of substantial force, and the grip will be enhanced by the type of material from which the panel is made. In addition, the panel will protect the person's skin against chaffing by contact with the gripped article and the consequent raising of blisters.

The panel 2 may be formed of one layer of material or a plurality of overlying layers. If desired, a pad 15 of shock absorbing, cushioning material may be interposed between adjacent layers. Further, the layer of the panel that is adapted to engage an article may be provided with a nubby surface to enhance the gripping characteristics of the panel.

Although the anchor strap 3 is elastic, the securing of the central portion 4 of the strap to the relatively inelastic panel renders the central portion virtually inelastic. Consequently, the stretching of the tensioning band 14 as a result of its application to the hand enables it to exert a force on the person's hand tending to maintain the hand in a position in prolongation of the forearm. That is, the tendency of the wrist to bend is resisted and the hand is supported, thereby lessening fatigue and the possibility of over-stressing the hand and wrist.

In some instances it may be desirable to minimize bending of the wrist laterally. This may be accomplished by the provision of a scabbard-like sleeve 16 along that side of the panel that will be located adjacent the outside edge of a person's hand. A transversely curved, stiff splint 17 formed of suitable plastic or metal may be fitted into the sleeve. The sleeve and the splint are of such length as to overlie part of the hand, the wrist, and part of the forearm, thereby inhibiting lateral bending of the wrist.

A grip enhancer and hand covering constructed according to the invention may be used by persons engaging in athletic and other activities such as rowing, paddling, raking, sweeping, batting, typing, or indeed in any activity wherein it is desirable to enhance the grip a person may exert on an object or provide support for a person's hand and wrist.

Figure 2:
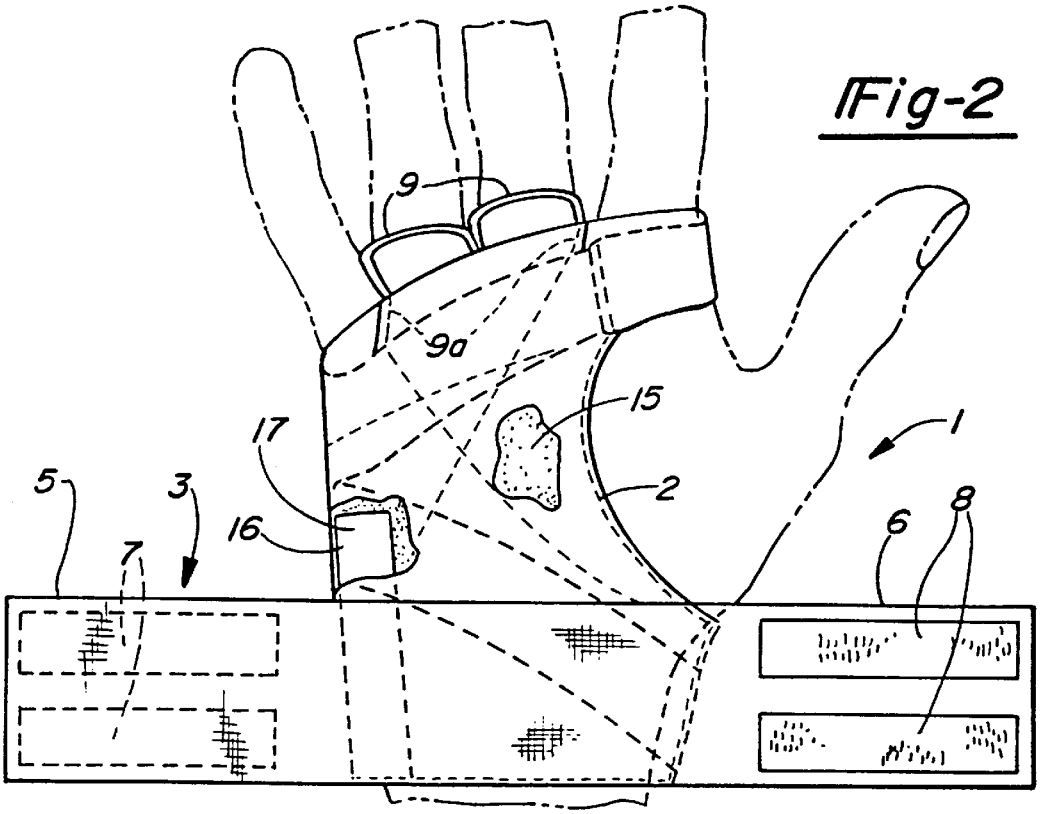
FIG. 2 is a plan view of the palm of the hand to which the grip enhancer is applied.

In accordance with an alternate embodiment, there is shown a grip enhancer article for golfing and the like, generally indicated by numeral 100 in FIGS. 3–5. Thus, in accordance with FIGS. 3–5, like elements as shown in FIGS. 1 and 2 are indicated in like numerals differing in the amount of 100. The primary difference between the embodiment shown in FIGS. 1 and 2 and the embodiment shown in FIGS. 3–5 is the absence of a diagonal strap which is not necessarily needed in a golfing type grip enhancer such as in the present invention. Additionally, the alternative embodiment comprises a construction which forms a continuum with the palm which is sustained throughout contraction and expansion of the hand.

Now referring to FIGS. 3–5, the palm covering panel portion 102 is preferably formed of a synthetic chamois material which provides gripping under even adverse wet or sweaty conditions. A preferred synthetic chamois is designated as MMC-5.00, man-made chamois, available from Bloch New England of Worcester, Me., e.g. a division of New England Kutting Mill. Additionally, the synthetic chamois material remains lightweight and pliable when wet and moreover, provides a cushioning affect when wet or dry. A backing layer 120 is applied to the planar surface facing the palm. Preferably, backing layer 120 is formed from a 50/50 cotton polyester blend which has been found effective to reduce moisture effects in the golfing application. The finger loops 109 are provided with a flat elastic type material which allows easier attachment and further longevity and toughness to the finished article. In this embodiment, the restraining bands (such as 9A) are not utilized.

As shown herein, in order to assure palm forming and non-bunching behavior of the article, a dart 122 (or permanent gather) is formed on the portion covering the heel of the palm on the side extending down from the pinky to the wrist, the inner periphery. Dart 122 forms an integral hump portion on the panel such that the gripping article forms a continuum with the contour of the palm throughout normal use without bunching. The integral hump portion causes the hand grip article to be curved in the shape of a palm whether or not it is placed on the wearer. Thus, a gripping article in accordance with the present invention, prevents blistering ordinarily caused by bunching of the material as the hand contracts to a gripping position. However, panel 102 is formed of large enough size so as to cover and protect the entire palm portion when the hand is in the extended or outstretched position. Additionally, grip enhancer article 100 includes an incline portion 124 provided to maximize the continuum formed with the contour of the palm. This construction provides maximum protection for the inner edge of palm without extraneous material. The incline portion 124 is generally at an acute angle B of from about 8° to about 12°, and preferably, from about 9½° to about 10° extending from axis A. The outer periphery of the panel portion 102, that side extending around the thumb to the wrist, is formed with curve 126. Curve 126 is at an angle which allows full movement of the thumb without interference from the grip enhancer article 100.

Additionally, the elastic utilized in this invention is preferably a belting elastic with about 60% stretch. It has been found that this type of elastic is sufficient for retention of the article on the hand without loosening and without undue tightness such that the article can be worn securely by a golfer or the like all day without bunching or binding of the article to the hand. Anchor strap 103 extends away at a downward angle D toward the forearm from a periphery edge designated by line C. Angle D is about 70° to about 95° and preferably about 90° extending away from line C. This construction allows strap 103 to comfortably encircle the wearer's wrist and secure the panel 102 in a maintained position.

The disclosed embodiment is representative of a presently preferred form of the invention, but is intended to be illustrative rather than definitive thereof. The invention is defined in the claims.

What is claimed is:

1. A hang grip enhancer article for palm protection and gripping enhancement of a wearer for use in activities including golf comprising:

a panel portion sized to substantially cover a palm;

an anchor strap attached to a wrist end of the panel; and a retaining band extending from and attached to a side edge of the panel and extending to and attached to an opposite side edge of the panel adjacent a finger junction end of the panel;

wherein the panel portion has a shape which forms a continuum with a palm of a hand of a wearer in a sustained position throughout expansion and contraction of the hand and wherein the panel portion includes a dart to form an integral hump portion to fit over a wearer's heel of the hand between a wearer's pinky finger and wrist for sustaining the continuum with the palm throughout expansion and contraction of the hand thereby preventing formation of blisters to the hand ordinarily caused by bunching.

2. The article of claim 1, wherein an inner periphery of the panel portion includes an incline extending from about the dart to the wrist end of the panel portion for conforming with an inner edge of the hand.

3. The article of claim 1, wherein the panel portion is formed from a synthetic chamois material.

4. The article of claim 1, wherein the panel portion is formed from a first and second layer wherein the first layer is formed from a material which provides traction and the second layer is formed from an absorbent material.

5. The article of claim 4, wherein the first material is formed from a synthetic chamois and the second material is formed from a cotton polyester blend.

6. The article of claim 1, wherein at least one flexible finger loop is attached to a periphery of the panel portion at the finger junction end, wherein the finger loop is formed from a flattened elastic material.

7. The article of claim 1, wherein an outer periphery of the panel portion includes a curve so as to circumvent interference with movement of a wearer's thumb.

8. The article of claim 1 further comprising at least one restraining loop for accommodating at least one finger.

9. The article of claim 8 wherein the at least one restraining loop is a plurality of restraining loops, each of which is adapted to accommodate a different finger.

10. The article of claim 8, wherein said at least one restraining loop is elastic.

11. The article of claim 1 further comprising at least one band for accommodation between two adjacent fingers.

12. The article of claim 1 further comprising a separable fastening means carried by said anchor strap for enabling said strap to be applied to and removed from the person's wrist.

13. The article of claim 12 wherein said fastening means is adjustable.

14. The article of claim 1 wherein said retaining band is elastic.

15. The article of claim 1 wherein said retaining band is composed of an extension of said panel portion having a free end to which one end of an elastic strap is secured, said elastic strap having its opposite end secured to said panel portion.

16. The article of claim 1 wherein said panel portion is composed of a plurality of overlying layers of pliable material.

17. The article of claim 1 wherein said panel portion comprises overlying layers of pliable material and a pad of pliable material between said layers.

18. The article of claim 1 wherein said anchor strap is relatively elastic and said panel portion is relatively inelastic, that portion of said anchor strap which is secured to said panel portion being rendered relatively inelastic by said panel.

19. The article of claim 1 wherein said panel portion has a sleeve extending along one edge thereof and an elongated splint accommodated in said sleeve.

20. The article of claim 19 wherein said split is transversely curved.

21. The article of claim 19 wherein said splint is of such length as to span the wrist and overlie a portion of the hand and forearm adjacent the wrist.

22. A hand grip enhancer article for removable application to a person's hand and wrist comprising:

a panel of such width and length as to overlie a palm of the person's hand and extend from an inner side of the palm to and from the person's wrist to a juncture of the person's palm and fingers, wherein the inner side extends from the person's wrist to a person's pinky finger base and has an incline so as to form a continuum with the hand and the outer side has a curve to allow uninhibited movement of a thumb;

a retaining band adjacent an end of the panel and extending from the inner side to the outer side of the panel in a position to overlie a back portion of the hand adjacent a knuckle area of the hand;

an anchor strap secured to the panel at the opposite end of the panel for encircling a wrist; and a dart at the inner side of the panel such that an integral hump is formed at a position corresponding with a heel of the palm.

23. The article of claim 22, wherein the panel is formed from a first layer superimposed over a second layer, wherein the first layer is formed from a material which provides traction and the second layer is formed from a material which is absorbent.

24. The article of claim 22, wherein the panel includes at least one flexible finger loop attached to an end adjacent the juncture of the person's palm and fingers, wherein the finger loop is formed from a flattened elastic material.

* * * * *